US005302325A

United States Patent [19]

Cheng

[11] Patent Number: 5,302,325

[45] Date of Patent: Apr. 12, 1994

[54] IN-LINE DISPERSION OF GAS IN LIQUID

[75] Inventor: Alan T. Cheng, Livingston, N.J.

[73] Assignee: Praxair Technology, Inc., Danbury, Conn.

[21] Appl. No.: 587,860

[22] Filed: Sep. 25, 1990

[51] Int. Cl.[5] ..... B01F 3/04

[52] U.S. Cl. ..... 261/76; 261/DIG. 78

[58] Field of Search ..... 261/DIG. 78, 76

[56] References Cited

U.S. PATENT DOCUMENTS

| | | | |
|---|---|---|---|
| 1,578,873 | 3/1926 | Welch | 261/76 |
| 1,810,131 | 6/1931 | Daily | 261/76 |
| 3,467,072 | 9/1969 | Tuesca | 261/76 |
| 3,778,038 | 12/1973 | Eversole et al. | 261/DIG. 87 |
| 3,953,548 | 4/1976 | Knapp et al. | 261/DIG. 78 |
| 4,639,340 | 1/1987 | Garrett | 261/36.1 |
| 4,861,352 | 8/1989 | Cheng | 55/53 |
| 4,867,918 | 9/1989 | Kiyonaga et al. | 261/76 |
| 4,931,225 | 6/1990 | Cheng | 261/76 |

*Primary Examiner*—Tim Miles

*Attorney, Agent, or Firm*—Alvin H. Fritschler

[57] ABSTRACT

The dispersion of a gas in a liquid is enhanced by accelerating a gas/liquid mixture to supersonic velocity, with subsequent deacceleration, in a conical in-line mixer.

17 Claims, 2 Drawing Sheets

IN-LINE DISPERSION OF GAS IN LIQUID

BACKGROUND OF THE INVENTION

1. Field of the Invention

This invention relates to the mixing of gases and liquids. More particularly, it relates to enhancing the dispersion of gases in liquids.

2. Description of the Prior Art

The dispersion of gases in liquids is an important feature of a wide variety of industrial operations. Thus, gases are dispersed in liquids for numerous gas dissolving, gas-liquid reaction and gas stripping of dissolved gas applications. As the gas is more finely dispersed in the liquid in the form of very small gas bubbles, the interfacial surface area between the gas and liquid is appreciably increased as compared to the surface area between the liquid and a like quantity of gas in the form of larger gas bubbles. In turn, an increase in the interfacial surface area between the gas and liquid is known to increase the mass transfer of the gas from the gas bubbles into the liquid, as well as the transfer of dissolved gas from the liquid into the gas bubble. Thus, by providing much higher interfacial area, all gas-liquid processes, such as gas dissolution, gas stripping and gas reactions between the gas phase and substances in the liquid phase will be improved.

The use of sonic shock waves to reduce the size of gas bubbles dispersed in a liquid is known in the art. Garrett, U.S. Pat. No. 4,639,340, discloses a particular technique directed particularly to the dissolving of oxygen in waste water. According to this technique, oxygen is uniformly dispersed in a waste water stream, which is then exposed to turbulent flow conditions and passed to a venturi for acceleration to a flow velocity in excess of the speed of sound in said gas/liquid mixture. A sonic shock wave is thereby created, and relatively coarse bubbles of oxygen are sheared into smaller bubbles by the turbulence resulting from the sonic shock wave.

Kiyonaga et al, U.S. Pat. No. 4,867,918, disclose an improvement comprising the combining of gas and liquid in close proximity to a venturi or other flow constriction means used to create supersonic flow velocities and subsequent deacceleration to subsonic velocity Cheng, U.S. Pat. No. 4,861,352, discloses an in-line stripping method employing a venturi device and capable of accelerating at least a portion of the stripping gas or vapor/liquid composition to a supersonic velocity for the composition. In a further development, Cheng, U.S. Pat. No. 4,931,225, has disclosed a method and apparatus for dispersing a gas or vapor in a liquid in which the gas or vapor is injected into the liquid at a linear velocity which is sonic for at least a portion of said gas or vapor at the time of contact, with a composition comprising the liquid and said gas or vapor being caused to flow cocurrently with at least a portion of the composition being caused to flow at a linear velocity that is at least sonic.

Despite such useful advances, there remains a need and desire in the art for further developments to enhance the dispersion of gases in liquids. Such requirements pertain to gas-liquid processing operations in general, and are related to the continual desire in the art for improvement in industrial processing operations and to the reduction of equipment fabrication costs associated therewith. There is also a general desire in the art for a more efficient use of oxygen, nitrogen and other industrial gases in a wide variety of commercial applications in which industrial gases are presently employed Or could be employed to improve current practice in the art.

It is an object of the invention, therefore, to provide an improved process and system for the dispersion of gases in liquids.

It is another object of the invention to provide a process and system for enhancing the interfacial surface area between a gas and a liquid in which it is dispersed so as to enhance the mass transfer between such gas and liquid.

It is a further object of the invention to provide a process and system capable of enhancing the efficiency of gas-liquid dispersion operations and of reducing fabrication costs for the gas-liquid dispersion system.

With these and other objects in mind, the invention is hereinafter described in detail, the novel features thereof being pointed out in the appended claims.

SUMMARY OF THE INVENTION

The dispersion of a gas in a liquid is enhanced by the use of a conical in-line mixer adapted to cause a very large portion of the gas/liquid mixture to accelerate to supersonic velocity, with subsequent deacceleration, thereby producing sonic shock waves within the mixture. By also initially injecting the gas into the liquid at sonic velocity, two consecutive shock waves are produced so that fine gas bubbles having enhanced interfacial surface area and extremely high mass transfer between gas and liquid is achieved.

BRIEF DESCRIPTION OF THE DRAWINGS

The invention is further described herein with reference to the accompanying drawings in which.

DETAILED DESCRIPTION OF THE INVENTION

The objects of the invention are accomplished by the providing of an annular flow, supersonic in-line gas/liquid mixer that can be easily inserted into a pipe or other line in which it is desired to achieve enhanced gas dispersion in the liquid. Such in-line mixer overcomes operating limitations associated with previously developed gas/liquid mixers wherein the velocity profile of a developing gas/liquid supersonic flow is highly non-linear across the diameter of the venturi device. In a conventional in-line stripper of the venturi type referred to above with respect to the Kiyonaga et al and the Cheng patents, it is found that, although the gas/liquid mixture might have an average velocity much higher than the theoretical sonic flow in said gas/liquid mixture, only a small portion of the flow at the center of the flow velocity profile across the diameter at the neck portion of the venturi is actually supersonic. The portion nearer the wall of the venturi is a viscous layer that remains at a subsonic velocity. Depending on the particular gas/liquid ratio employed, the velocity of sound in an air/water mixture, for example, may be on the order of about 20 meters per second.

By the use of the conical in-line mixer of the invention, the velocity profile is flattened through the thin layer between the cone of the in-line mixer and the wall of the pipe or other line, while the total minimum cross sectional area for liquid flow remains the same as in the previously developed in-line strippers referred to above. This effect causes a very large portion of the flow to be in the supersonic range, which is necessary to produce shock waves within the gas/liquid mixture necessary to enhance the desired dispersion of the gas in the liquid.

Figure 1:
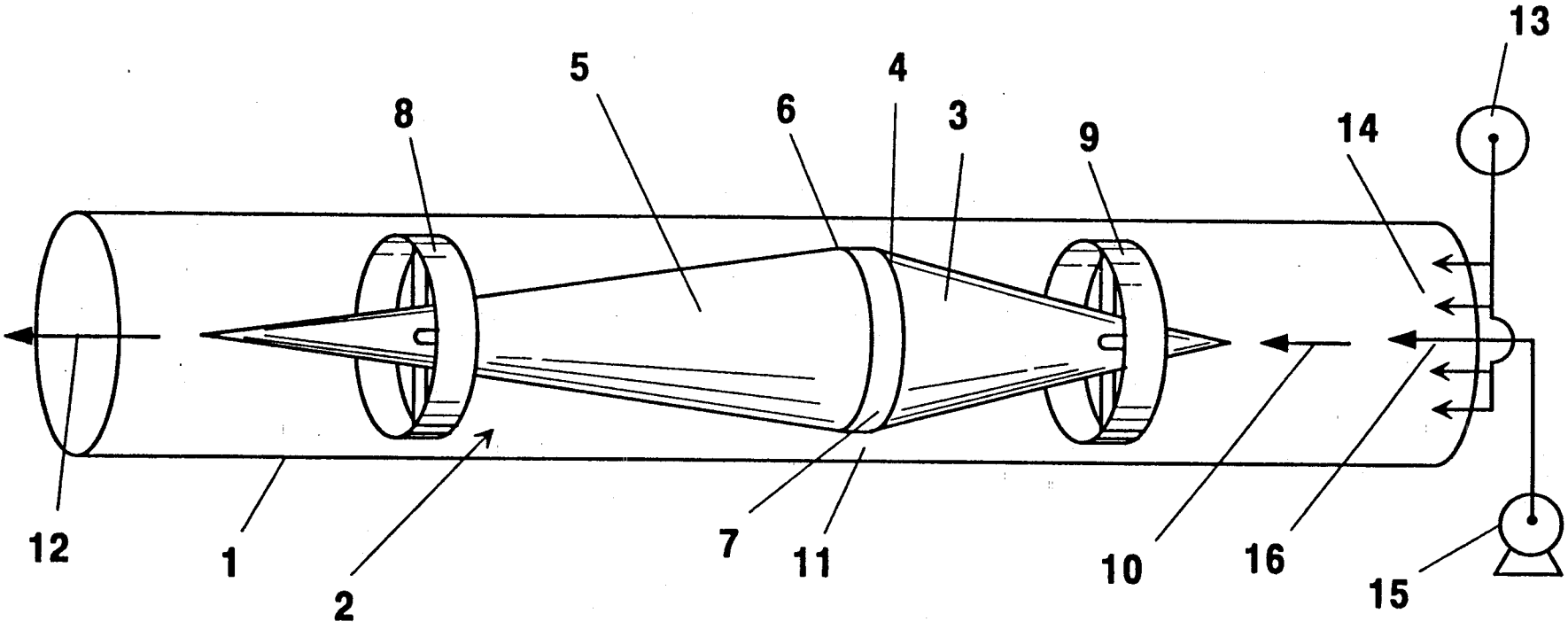
FIG. 1 is a side elevational view of an embodiment of the conical in-line mixer of the invention.

A representative conical in-line mixer is illustrated in FIG. 1 of the drawings, wherein the numeral 1 represents a pipe into which conical in-line mixer 2 can easily be inserted. Said conical mixer 2 comprises a cone 3 having its enlarged section 4 positioned in the downstream direction, and a companion cone 5 affixed thereto and having its corresponding enlarged section 6 positioned adjacent that of cone 3 in the enlarged intermediate portion 7 of overall conical mixer 2. Support rings 8 and 9 are used to position conical mixer 2 in pipe 1. A gas/liquid mixture generally represented by the numeral 10 passes through the pipe in the direction of cone 3 at a flow velocity of less than the velocity of sound in the gas bubble/liquid mixture. This mixture is accelerated to supersonic speed as it passes through the thin layer of annular opening 11 between cone 3 at its largest diameter and the wall of pipe 1. Liquid stream 12 having an enhanced dispersion of said gas therein is recovered at the downstream end of pipe 1.

Annular opening 11 is found to enable gas stripping, gas dissolution or other gas/liquid mixing rates to be achieved that are substantially greater than that achievable in comparable venturi-type gas/liquid mixers. The invention is particularly suitable for use in large size systems employing high liquid velocities, as in pipe systems larger than about three inches. At such larger sizes, any tendency of a liquid comprising a slurry to clog the system, as in smaller size systems, is obviated. The conical in-liner mixer of the invention is also more economical to fabricate in such larger size systems.

In a preferred embodiment of the invention, fine gas bubbles with an extremely high mass transfer surface area are produced as a result of two consecutive sonic shock waves. The first sonic shock wave is formed when the gas in injected into the liquid stream at sonic velocity. The second shock wave is formed when the gas and liquid mixture is accelerated to a speed higher than the sonic sound level in said gas/liquid mixture in the annular opening 11 and is then deaccelerated to subsonic velocity as it passes through the cone 5 portion of the overall conical in-line mixer 2. With respect to the initial shock wave, flow means 13 are provided to enable liquid represented by the numeral 14 to flow through pipe 1 in the direction of said mixer 2, with gas from gas supply source 15 being injected therein through gas injector 16 at said supersonic velocity level to form the desired gas bubble/liquid mixture.

Figure 2:
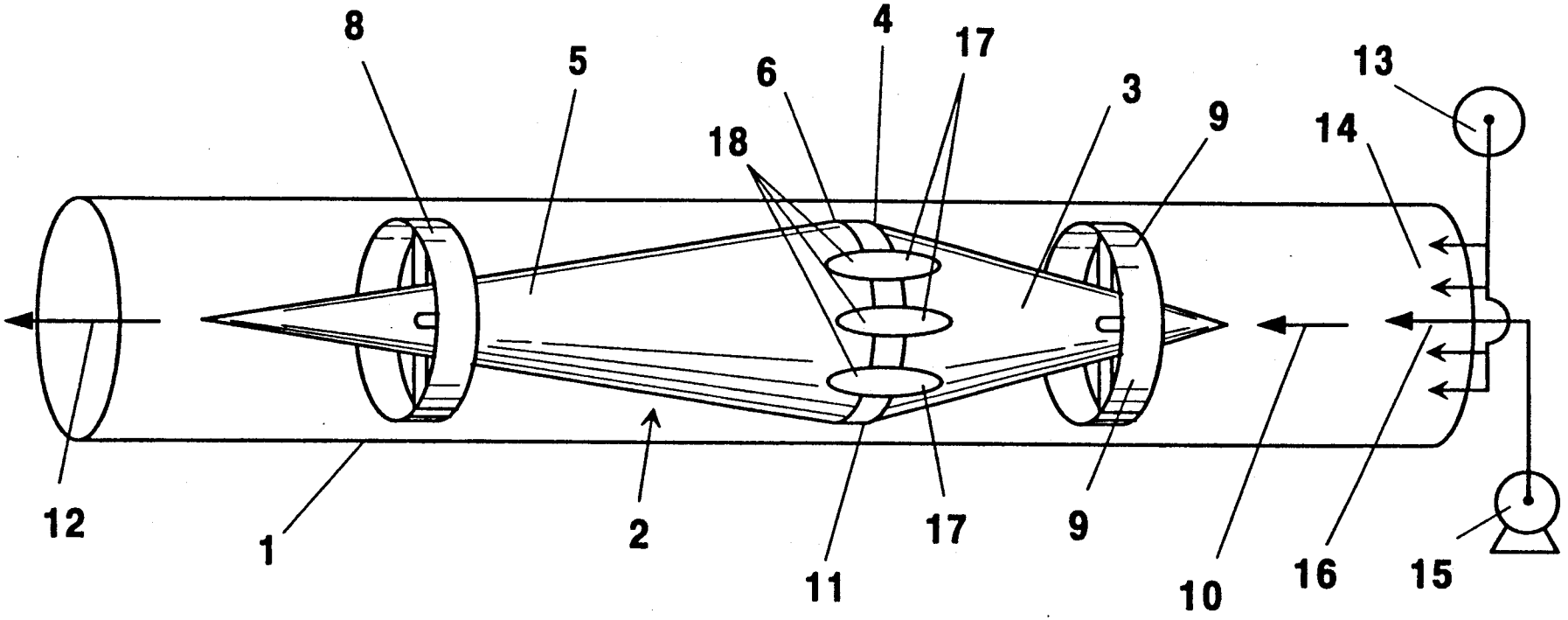
FIG. 2 is a side elevational view of an alternative embodiment of the conical in-line mixer of the invention.

It will be understood that various changes and modifications can be made in the details of the invention without departing from the scope thereof as set forth in the appended claims. In one alternative embodiment, the annular opening 11 can be replaced or supplemented by a series of holes in cones 3 and 5 as illustrated in FIG. 2 of the drawings. In this embodiment, cones 3 and 5 are shown with coinciding openings or holes 17 and 18 at enlarged sections 4 and 6, respectively. This arrangement, as well as that of the smooth conical mixer shown in FIG. 1, will provide a high mass transfer rate at a comparable pressure drop with respect to the venturi-type in-line stripper as long as the total opening area for gas/liquid mixture flow remains the same. In this regard, it should be noted that the dual cone arrangement of the invention is needed in order to reduce or minimize the pressure drop associated with the gas/liquid mixing operation. Thus, the gas/liquid mixture could be accelerated to supersonic velocity upon contact with cone 3 and passage through annular opening 11, with rapid expansion and rapid deacceleration in the absence of downstream cone 5, but with an unduly large pressure drop and energy loss. This undesirable condition is precluded by the use of said cone 5. It will be understood that the shape of cone 5 may either be the same or may differ from that of cone 3. Apart from having essentially the same diameter at enlarged sections 4 and 6, the cones will typically differ in that downstream cone 5 will generally be made longer, with a lesser angle of convergence to the tip section of the cone than is employed with respect to upstream cone 3. Such an arrangement is desirable as it enhances pressure recovery from the process. If a relatively short, greater angled cone were to be employed for downstream cone 5, a greater pressure drop would be experienced across conical in-line mixture 2. Those skilled in the art will appreciate that the dimensions employed in the design of the conical in-line mixer of the invention will vary depending on the particular gas/liquid mixing operation being carried out, the size of the line through which the liquid, or the gas in similar embodiments in which a liquid is injected into a flowing gas stream, the applicable operating conditions and the like.

In an illustrative example of the practice of the invention, the conical in-line mixer of the invention was used for the stripping of a dissolved component, oxygen, from water flowing through a 0.825" inside diameter line at a flow rate of 3 gallons per minute at a temperature of 24.5° C. Nitrogen was used as the stripping gas. A conical in-line mixer as shown in FIG. 1 having an annular opening 11 with essentially the same total opening area as that of a venturi-type in-line mixer used for comparative purposes was employed. The conical mixer comprised cone 3 having an enlarged section of 0.803", said cone configured at an angle of 21° and having a length of 1.71", and cone 5 having the same enlarged section configured at an angle of 15° and having a length of 2.41", the enlarged intermediate portion 7 of 0.191" length. A significant improvement in the mass transfer rate, up to 25% or more, was obtained using the annular flow, conical in-line stripper of the invention as compared to the results obtained using a venturi-type in-line mixer. In runs using nitrogen flow rates up to about 0.5 scfm, an improvement in the fractional reduction of oxygen was found to occur consistently in the use of an annular flow in-line stripper as compared to the results obtained using a comparable venturi-type of in-line stripper. As referred to herein, the term "fractional reduction" means the ratio of the concentration in, i.e. the initial concentration of a component, oxygen in this case, upstream of the in-line stripper, minus the concentration out, i.e. the concentration of said component at a location immediately downstream of the in-line stripper, divided by said concentration in. At a nitrogen flow rate of about 0.1 scfm, the fractional reduction was about 0.3 for the venturi and about 0.4 for the conical stripper of the invention. At about 0.2 scfm flow rate, the fractional reduction was about 0.5 for the venturi and about 0.56 for the conical stripper. At about 0.3 scfm flow rate, the fractional reduction had increased to about 0.62 for the venturi and to about 0.7 for the conical mixer. At about 0.45 scfm of nitrogen, the fractional reduction reached about 0.72 for the venturi and about 0.8 for the conical mixer. Such a consistent improvement in gas/liquid dispersion and resulting improvement in mass transfer rate represents a highly desirable advance in the stripping art, with such desirable results having been obtained with compatible pressure recovery levels.

The invention has the additional advantage of being easily constructed, and no specific piping modifications are needed for its application in gas/liquid dispersion operations. The machining costs associated with the conical in-line mixer of the invention are substantially less than those required in the fabricating of a venturi-type device. As indicated above, a slurry can cause a clogging of the mixer in some applications, particularly when the slurry contains a high concentration of solids. It is for this reason, therefore, that the conical in-line mixer is found to be useful in large pipelines when slurry operations are involved, e.g. as indicated above, in lines having a diameter of about 3" or more.

It will be appreciated that the invention can be used in desirable gas/liquid mixing operations not only of the gas stripping nature, or for dissolving a gas in a liquid, but also for practical gas/liquid reactions, such as for oxygenation or hydrogenation of organic chemicals or other materials available in liquid or slurry form. In all such operations and with desirable pressure recovery, the conical in-line mixer of the invention enables the dispersion of a gas into a liquid to be enhanced, providing enhanced mass transfer between very fine gas bubbles and the liquid. As a result, the invention provides an enhanced system and process for a wide variety of gas/liquid dispersion operations in practical, industrially significant gas/liquid dissolution, stripping or reaction applications, including gas stripping operations involving the desired removal of a gas entrained in a liquid stream or dissolved therein, or the desired removal of a volatile liquid component of the liquid stream being treated in accordance with the invention.

I claim:

1. An improved system for the dispersion of a gas in a liquid comprising:

(a) a flow line in which said gas and liquid are to be mixed;

(b) flow means for passing one of the fluids to be mixed through said flow line;

(c) injection means for injecting the other fluid for the desired mixture of gas and liquid into said flow line to form a gas bubble/liquid mixture;

(d) a conical in-line mixer positioned in said flow line downstream of the point at which said gas bubble/-liquid mixture is formed, said conical in-line mixer comprising a first cone portion having its enlarged section positioned in the downstream direction and a second cone portion having its enlarged section adjacent that of the first cone portion and its pointed end section positioned downstream thereof, the enlarged sections of said cone portions of the mixer being of essentially the same diameter and forming an enlarged intermediate portion of the mixer, said enlarged intermediate portion being such as to provide an annular opening between said enlarged intermediate portion and the wall of said flow line, said first cone portion having a flow passage of decreasing flow area enabling the acceleration of the flowing gas bubble/liquid mixture such that a large portion thereof will be accelerated therein to a supersonic velocity, with subsequent deceleration of the flowing gas bubble/liquid mixture to a flow velocity in the subsonic range upon passage through said second cone portion of the conical mixer, such acceleration-deceleration action of the conical mixer serving to create a sonic shock wave effect resulting in the fine dispersion of the gas bubbles in the liquid.

2. The system of claim 1 in which said second cone portion is longer and has a lesser angle of convergence to the pointed end section than said first cone portion.

3. The system of claim 1 in which said flow means comprise means for passing liquid through the flow line, and said injection means comprise means for injecting gas into the liquid passing through said flow line in the direction of said conical in-line mixer.

4. The system of claim 1 in which said injection means comprise means for injecting said other fluid at a sonic velocity so as to create an initial sonic shock wave, said initial shock wave and said sonic shock wave produced in the conical mixer resulting in very fine dispersion of the gas bubbles in the liquid, with an extremely high mass transfer surface area being produced as a result of the consecutive sonic shock waves in the gas bubble/liquid mixture.

5. The system of claim 4 in which said flow means comprise means for passing liquid through the flow line, and said injection means comprise means for injecting gas into the liquid passing through said flow line in the direction of said conical in-line mixer.

6. An improved process for the dispersion of a gas in a liquid comprising:

(a) combining said gas and liquid to form a gas bubble/liquid mixture in a flow line, said mixture having a velocity of less than the velocity of sound in said gas bubble/liquid mixture;

(b) passing said gas bubble/liquid mixture into contact with a conical in-line mixer positioned in said flow line, said conical in-line mixer comprising a first cone portion having its enlarged section positioned in the downstream direction and a second cone portion having its enlarged section adjacent that of the first cone portion and its pointed end section positioned downstream thereof, the enlarged sections of said cone portions of the mixer being of essentially the same diameter and forming an enlarged intermediate portion of the mixer, said enlarged intermediate portion being such as to provide an annular opening between said enlarged intermediate portion and the wall of said flow line, said first cone portion having a flow passage of decreasing flow area enabling the acceleration of the flowing gas bubble/liquid mixture such that a large portion thereof will be accelerated therein to a supersonic velocity, with subsequent deceleration of the flowing gas bubble/liquid mixture to a flow velocity in the subsonic range upon passage through said second cone portion of the conical mixer, such acceleration-deceleration action of the conical mixer serving to create a sonic shock wave effect resulting in the fine dispersion of the gas bubbles in the liquid; and (e) removing the fine dispersion of gas bubbles in the liquid from the downstream portion of the flow line.

7. The process of claim 6 in which said second cone portion is longer and has a lesser angle of convergence to the pointed end section than said first cone portion.

8. The process of claim 6 in which the liquid is passed through the flow line in the direction of said conical in-line mixer, and gas is injected into said liquid.

9. The process of claim 6 and including injecting one fluid into the other at a sonic velocity so as to create an initial sonic shock wave, said initial sonic shock wave and said sonic shock wave produced in the conical mixer resulting in very fine dispersion of the gas bubbles in the liquid, with an extremely high mass transfer surface area being produced as a result of the consecutive sonic shock wave in the gas bubble/liquid mixture.

10. The process of claim 6 in which said gas/liquid dispersion comprises a process in which the gas is used to strip a gas or volatile component from a liquid.

11. The process of claim 6 in which said gas/liquid dispersion comprises a process for the reaction of the gas and liquid.

12. The process of claim 6 in which said gas/liquid dispersion comprises a process for the dissolving of the gas in the liquid.

13. An improved system for the dispersion of a gas in a liquid comprising:

(a) a flow line in which said gas and liquid are to be mixed;

(b) flow means for passing one of the fluids to be mixed through said flow line;

(c) injection means for injecting the other fluid for the desired mixture of gas and liquid into said flow line to form a gas bubble/liquid mixture;

(d) a conical in-line mixer positioned in said flow line downstream of the point at which said gas bubble/-liquid mixture is formed, said conical in-line mixer comprising a first cone portion having its enlarged section positioned in the downstream direction and a second cone position having its enlarged section adjacent that of the first cone portion and its pointed end section positioned downstream thereof, the enlarged sections of said cone portions of the mixer being of essentially the same diameter and forming an enlarged intermediate portion of the mixer, said enlarged intermediate portion being such as to provide an annular opening between said enlarged intermediate portion and the wall of said flow line, and including openings for the passage of said gas bubble/liquid mixture in the enlarged sections of said first and second cones at the enlarged intermediate portion of the conical mixer, said openings together with the annular opening between said enlarged intermediate portion of the conical mixer and the wall of the flow line being adapted to accelerate a high portion of the gas bubble/liquid mixture to supersonic velocity, with subsequent deceleration to subsonic range upon passage through said second cone portion of the conical mixer, such acceleration-deceleration action of the conical mixer serving to create a sonic shock wave effect resulting in the fine dispersion of the gas bubbles in the liquid.

14. The system of claim 13 in which said flow means comprise means for passing liquid through the flow line, and said injection means comprise means for injecting gas into the liquid passing through said flow line in the direction of said conical mixer.

15. The system of claim 14 in which said injection means comprise means for injecting said other fluid at a sonic velocity so as to create an initial sonic shock wave, said initial shock wave and said sonic shock wave produced in the conical mixer resulting in a very fine dispersion of the gas bubbles in the liquid, with an extremely high mass transfer surface area being produced as a result of the consecutive sonic shock waves in the gas bubble/liquid mixture.

16. An improved process for the dispersion of a gas in a liquid comprising:

(a) combining said gas a liquid to form a gas bubble/-liquid mixture in a flow line, said mixture having a velocity of less than the velocity of sound in said gas bubble/liquid mixture;

(b) passing said gas bubble/liquid mixture into contact with a conical in-line mixer positioned in said flow line, said conical in-line mixer comprising a first cone portion having its enlarged section positioned in the downstream direction and a second cone portion having its enlarged section adjacent that of the first cone portion and its pointed end section positioned downstream thereof, the enlarged sections of said cone portions of the mixer being of essentially the same diameter and forming an enlarged intermediate portion being such as to provide an annular opening between said enlarged intermediate portion and the wall of said flow line, said enlarged sections of the first and second cones having openings therein for the passage of said gas bubble/liquid mixture at the enlarged intermediate portion of the conical mixer, said openings together with said annular opening being adapted to accelerate a high portion of the gas bubble/liquid mixture to a supersonic velocity in the vicinity thereof, with subsequent deceleration of the flow velocity to subsonic range upon passage through said second cone portion of the conical mixer, such acceleration-deceleration action of the conical mixer serving to create a sonic shock wave effect resulting in the fine dispersion of the gas bubbles in the liquid; and (c) removing the fine dispersion of gas bubbles in the liquid from the downstream portion of the flow line.

17. The process of claim 16 in which the liquid is passed through the flow line in the direction of said conical in-line mixer, and gas is injected into said liquid.

* * * * *